United States Patent [19]

Kiejzik

[11] 4,173,837

[45] Nov. 13, 1979

[54] MICROFILM JACKET MICROFILM FEEDING DEVICE AND PROCESS

[76] Inventor: Paul A. Kiejzik, 2907 Monterey Ct., Springfield, Pa. 19069

[21] Appl. No.: 845,483

[22] Filed: May 13, 1976

Related U.S. Application Data

[62] Division of Ser. No. 611,004, Sep. 8, 1975, Pat. No. 4,003,187.

[51] Int. Cl.[2] ..... G09F 1/10

[52] U.S. Cl. ..... 40/159; 206/390; 229/72

[58] Field of Search ..... 229/72, 69; 206/390; 40/16, 159

[56] References Cited

U.S. PATENT DOCUMENTS

| | | | |
|---|---|---|---|
| 3,254,828 | 6/1966 | Lerner | 229/69 |
| 3,267,623 | 8/1966 | Block | 206/390 |
| 3,491,471 | 1/1970 | Semple | 40/16 |
| 3,553,439 | 1/1971 | Dorman | 40/159 |
| 3,705,464 | 12/1972 | Dahl, Jr. | 40/159 |
| 3,736,680 | 6/1973 | Dahl, Jr. | 40/159 |
| 3,795,163 | 3/1974 | Armstrong et al. | 229/69 |
| 3,826,026 | 7/1974 | Bevan | 40/16 |
| 3,866,648 | 2/1975 | Anderson | 40/159 |
| 3,872,645 | 3/1975 | Dorman | 229/72 |

FOREIGN PATENT DOCUMENTS

| | | | |
|---|---|---|---|
| 2026954 | 12/1971 | Fed. Rep. of Germany | 229/72 |
| 1386458 | 3/1975 | United Kingdom | 229/72 |

*Primary Examiner*—Stephen P. Garbe

[57] ABSTRACT

In a preferred embodiment, there is provided a microfilm jacket support supportable of a flat microfilm jacket in a horizontal position in an anchored state with a leading edge of the jacket extending beyond the support when mounted thereon, and with a microfilm insertion opening into microfilm jacket reservoir space being positioned at the edge of the support face-up when mounted on the support, and as a part of the combination additionally there being an upper edge pressure-flexing mechanism for flexing downwardly the leading edge extending beyond the support adjacent the insertion opening, and a feeding mechanism for aligning a longitudinal elongated axis of the microfilm with a longitudinal elongated axis of the microfilm jacket reservoir space and with the insertion opening and for feeding advancingly intermittently microfilm into the insertion opening and for intermittently severing microfilm, and additionally for mounting in association with microfilm immediately adjacent the insertion opening a microfilm projection mechanism for viewing a microfilm frame about to be inserted.

3 Claims, 8 Drawing Figures

FIG. 2
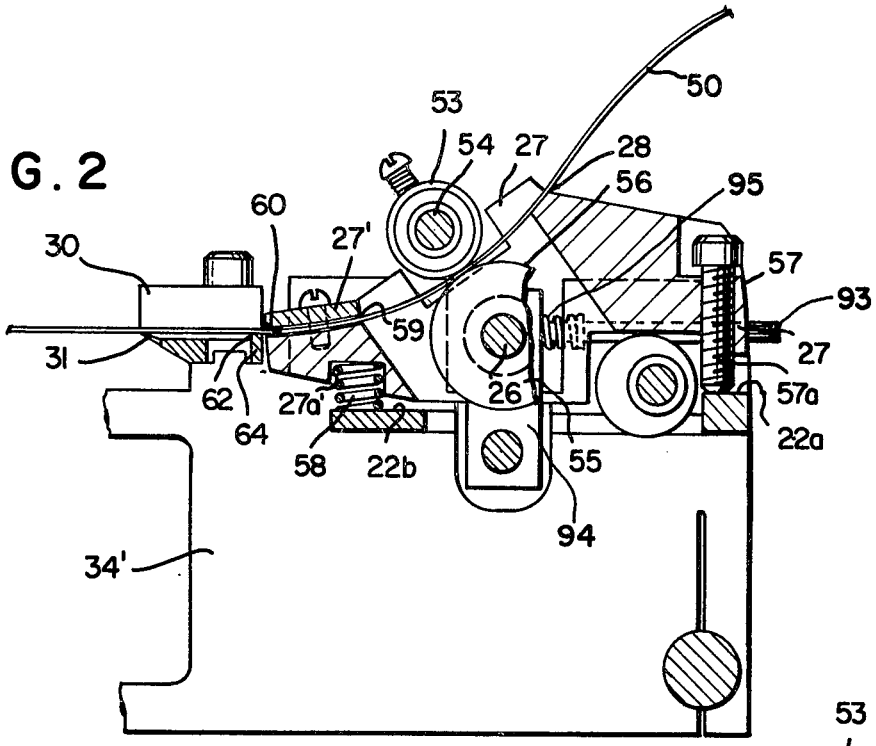
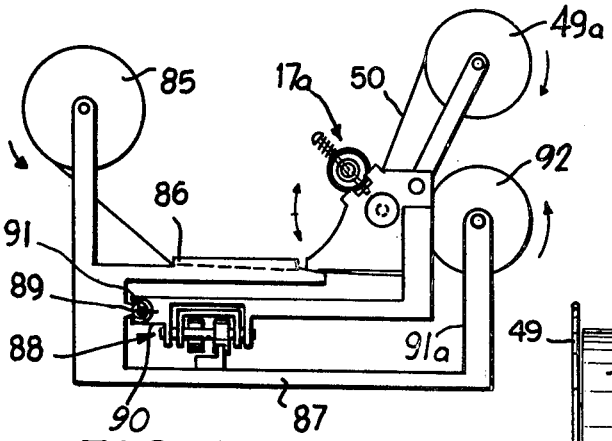
FIG. 1
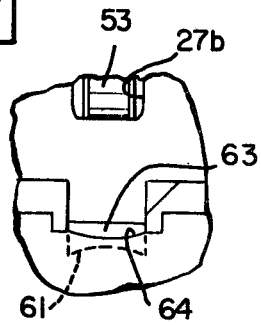
FIG. 4
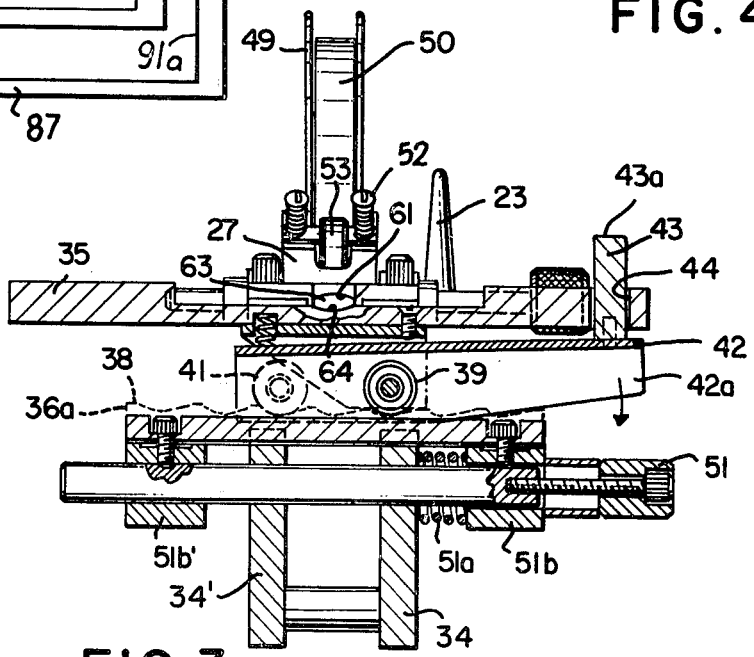
FIG. 3

FIG. 5
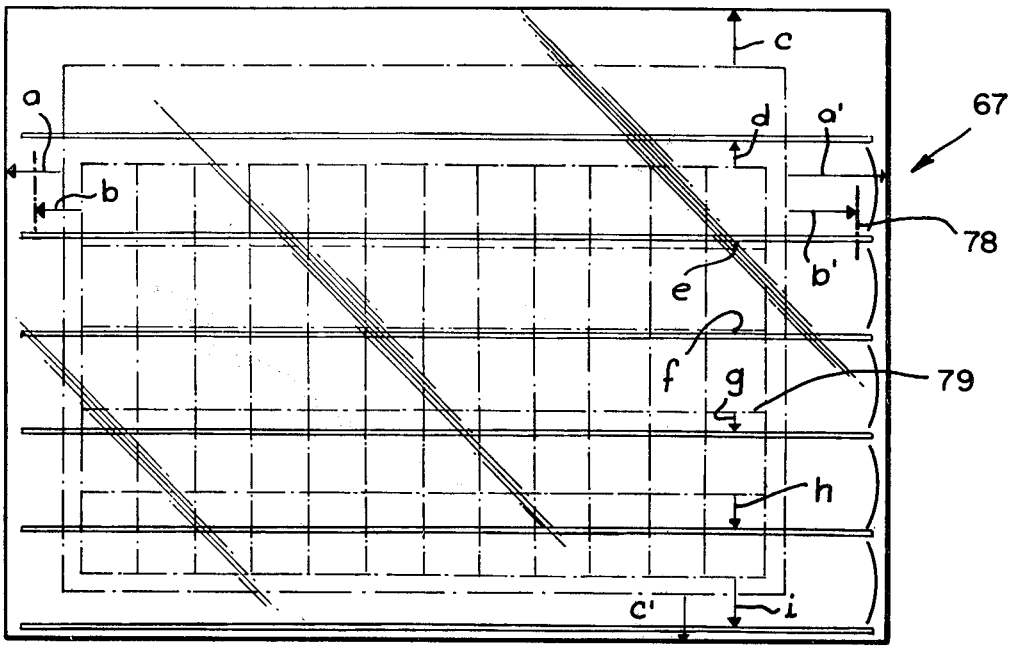
FIG. 6
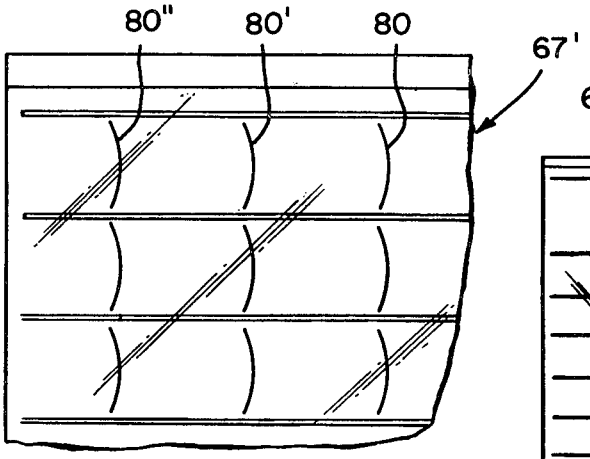
FIG. 7
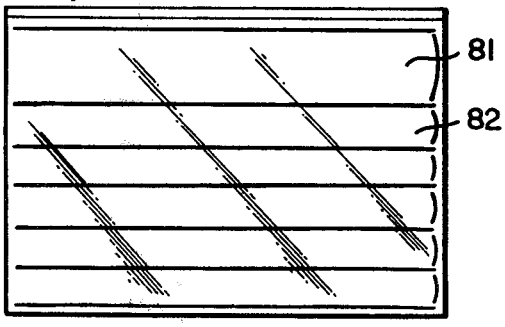
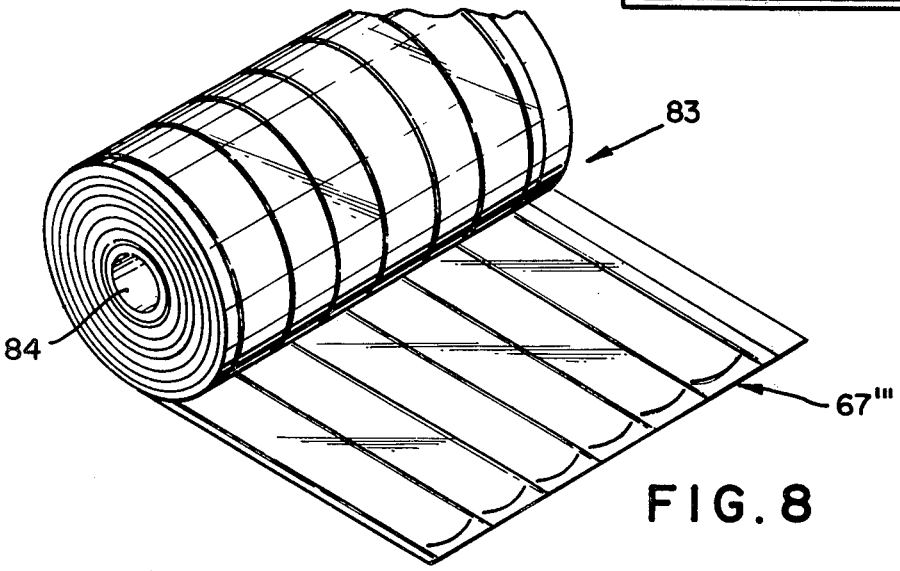
FIG. 8

MICROFILM JACKET MICROFILM FEEDING DEVICE AND PROCESS

This is a divisional of application Ser. No. 611,004, filed Sept. 8, 1975, now U.S. Pat. No. 4,003,187.

This invention relates to a novel microfilm jacket support and microfilm insertion apparatus and process.

BACKGROUND TO THE INVENTION

Prior to the present invention there has been no mechanical apparatus for appropriately inserting microfilm strip(s) into microfilm storage jackets, much less on a rapid pace and efficient and fool-proof basis, as well as the cutting of frames of one subject matter from frames of another subject matter heretofore having been a time-consuming laborious job.

SUMMARY OF THE INVENTION

Accordingly, objects of the present invention include the obtaining of an apparatus and process which overcome and/or avoid problems of the types referred to above, together with other novel advantages.

Another object is to obtain a microfilm jacket support and insertion device facilitating the easy insertion of a microfilm strip thereinto.

Another object is to obtain a microfilm jacket support and insertion viewing apparatus.

Another object is to obtain a microfilm jacket support and microfilm frame-severing device.

Another object is to obtain a microfilm jacket support and film insertion advancing device.

Another object is to obtain a novel microfilm jacket having serially arranged film reservoirs as a belt.

Another object is to obtain a reeled microfilm jacket belt for feeding microfilm jackets serially.

Another object is to obtain a process of microfilm insertion into a microfilm jacket.

Other objects become apparent from the preceding and following disclosure.

One or more objects are obtained by the invention as defined in the preceding and following disclosure.

Broadly the invention may be defined as a microfilm jacket microfilm-inserter device including a support which holds the jacket in a predetermined position with a portion of the reservoir defining structure above the insertion opening at a leading end of the jacket extending beyond a pivot point of support of an underface of the jacket, and including a pressure-applying structure as a microfilm jacket edge-flexing mechanism to bend downwardly the unsupported portion of the leading end of the jacket by applying pressure to an upper surface thereof, adapted such that the opening is broadly exposed of the reservoir space whereby a microfilm end insertion is thereby facilitated. In various preferred embodiments as shall be more fully described in the detailed description, there is included as a part of the unitary combination an insertion mechanism for lining-up microfilm to be inserted with the elongated longitudinal axis thereof aligned lineally with the elongated longitudinal axis of the reservoir space into which the microfilm is to be inserted, and additionally a cutting mechanism for cutting related frames from unrelated frames while within the insertion mechanism or adjacent thereto, and additionally an advancing mechanism, and additionally a structure providing for receipt of desired and/or conventional image projection device(s) at a point adjacent to the point of insertion such that the subject matter about to be inserted may be viewed, this also facilitating the combination element for cutting-away a segment since by the viewer one determines where the related subject matter begins and ends and where the next begins. By the present invention, thereby it is possible to efficiently and speedily review film frames of microfilm at the point of insertion into a storage microfilm jacket at the time of severence of the related strip frames from other frames, by a speedy insertion.

In a further improved and preferred embodiment, there is provided a feed reel mechanism and novel serially arranged microfilm jackets having their longitudinal elongated-axis jacket structures arranged end-to-end consecutively as a continuous belt with intermittent insertion openings, and further preferably also with a take-up reel such that the film jacket is not severed at any time but is merely wound upon a further storage reel, or temporary storage further reel before rewinding upon the original feed reel. The reservoirs may also be additionally in parallel.

It is also contemplated that some of the reservoir channels may be broader than others whether or not serially arranged or with parallel arranged reservoirs.

The invention may be better understood by making reference to the following Figures.

THE FIGURES

FIG. 1 illustrates in side elevation view, an embodiment of a machine for practicing the process of this invention.

FIG. 2 illustrates an in-part view in side view with partial cut-away with one side of an apparatus for practicing the process of this invention, whereby interior mechanism is viewable.

FIG. 3 illustrates a cross-sectional view of a microfilm jacket support structure, and the apparatus of FIG. 2.

FIG. 4 illustrates an in-part and enlarged view of a particular portion of the FIG. 3 illustration, except in a cutting-of-microfilm state, as it would appear when microfilm strip has been severed.

FIG. 5 illustrates typically a microfilm jacket lying over an international grid standard sheet, all in elevation plan view.

FIG. 6 illustrates in an in-part view another and further improved microfilm jacket with a plurality of consecutive mouths (slits) for a common channel space extending along between parallel seals.

FIG. 7 illustrates an embodiment in which at least one of the channels is substantially wider than others of the channels of the microfilm jacket, illustrated in elevation plan view.

FIG. 8 illustrates in an in-part view in perspective view, a roll of microfilm jacket in a continuous elongated jacket-strip otherwise substantially similar to that of the FIG. 6 embodiments.

DETAILED DESCRIPTION OF THE INVENTION

In greater detail, all of FIGS. 1, 2, 3, 4, 5 relate to the basic common preferred embodiment of the feeding device and microfilm jacket utilizable therewith. The embodiment of FIG. 1 illustrates an alternate feeding mechanism as shall be described in greater detail hereinafter.

In like manner, FIGS. 6 through 8 illustrate alternate embodiments of the novel microfilm jackets.

FIG. 1 illustrates a feeding device for microfilm jackets of the invention, having a feed and cutter mechanism, and a carriage mechanism. The feed and cutter mechanism are designed as to receive a microfilm projector, for projecting an image.

A cutter-iniating handle 23 causes feed and cutter mechanism structure 24 to pivot as shall be described in greater detail below. A handle, typically a knob, is utilized typically for revolving to advance microfilm by a turning of a shaft 26 on which shaft also the feed cutter mechanism structure is pivoted. Channel-defining structure 27 defines a microfilm channel seat and mouth 28 for receiving and channeling microfilm, and at location there is microfilm channel outlet port exit, from which exit microfilm is fed along a channel seat defined adjacent the structure 30 from which channel the microfilm is fed into the open mouth of a microfilm jacket opened by mechanism of the feeding device. In particular, there is an overhang having a lower surface 31, against which upper surface, 32 presses, the upper surface 32 being a downwardly inclined surface, and the key 34*a* coordinating with the key 33 to assure correct alignment.

The upper surface 32 is a part of the overall carriage structure platform 35, pivotably mounted onto a pivot bar with a spring-biased releasable latching lock latchable at any one of alternate positions ranging in directions extending transversely across the width as defined by the alternate-slot-defining structure 36*a*, and providing a roller track surface 38 for wheel 39 when the carriage platform 35 is being moved laterally from one slot to the other by pressing downwardly on the lever 43*a* in a manner such that the roller 41 becomes lifted pivotably from a slot recess locking position and state to above the surface 38. Structure 42*a* and 42*b* have the wheel 41 mounted thereon while this structure is mounted on an axis, secured to spaced-apart flanges extending downwardly from the carriage platform 35. Lower surface 43*b* represents an upper surface between the downwardly-extending flanges, against which upper surface 43*b* the structure 42 normally presses in a locked state as a result of a spring biasing action of a spring viewable in FIG. 3. A lever button 43 while pressing downwardly upon the structure 42, extends upwardly through a through-space 44, in the platform 35. The platform 35 is anchored through an appropriate typically metal strip by an anchoring bolt into a mounting structure. Reel 49, as a feed reel feeds tape 50 into the channel mouth 28 defined by the structure 27. Anchor structure 51*b* provides for utilization of revolvable handle or knob 51 for adjusting the extent to which the carriage is aligned laterally in one direction or the other, for aligning the end portion 32 appropriately such that the particular channel to receive microfilm is precisely positioned before the exit port and in series with channel 60, the consecutive channel defined beside the structure 30. Mounting spring-carrying threaded screw or bolt 52 extends through the shaft 54 around which the wheel 53 is rotatably mounted. Accordingly, the shaft 53 is biased by the spring on the bolt 52 into a flush and contacting the rolling relationship with a wheel mounted on the shaft 26, the wheel being fixedly mounted thereon to turn only when the shaft is turned. This relationship is best seen in FIG. 2, in which the opposing relationships of the surfaces of the wheel 53 and the shaft-mounted wheel 55 having surface 56. Position-adjusting bolt 57 adjusts the position at which the pivoting structure 27 normally rests with the channels of feed properly aligned with the ports receiving microfilm therefrom. Accordingly, the bolt 57 has its threaded shaft 57*a* extending through the structure 27, to rest against the structure 22*a*. In FIG. 2, in particular, the spring 58 which biases the pivoted structure upwardly into a stable position is also illustrated. In this Figure, the mouth 59 is also disclosed for the channel 60 having the outlet mouth-defining structure 63 defining the outlet mouth 61, from which the film 50 is fed into a concave channel seat 62 located between structures 30, as for example may be seen in FIG. 7. The structure 64 defines therethrough a through-channel 70 overwhich the microfilm may be brought to rest and through which a light from beneath may be shone upwardly into a lens of a microfilm projector arranged.

In the FIG. 3 and FIG. 4 illustrations, the channeling position and structure 63 in the open state is viewable, while in the FIG. 5A it is shown after the cutting handle has been pressed typically in a clockwise direction around its pivot point to cause the structure 63 to move downwardly whereby the upwardly concave angular mouth 61 serves to cut the seat 43. Accordingly, the severed film would then be pushed further into a microfilm jacket channel by further advancing the film severed therefrom in a pushing relationship. Spring 95 on knob 93 biases structures 27 and 94. In order to make insertion reasonably possible and speedy, done heretofore substantially always by hand, the film heretofore had to be inserted by virtue of a cut-out section defining a port having a recessed lip away from the forward lip for insertion of the microfilm thereinto. A particular disadvantage of such a prior art situation is that the microfilm frame is left exposed for the frame of a strip on the end thereof last inserted under the conventional system of insertion into such a prior art jacket, the trailing end of the strip of film substantially never being pushed totally beneath the upper sheet beyond the cut-out port, thereby resulting in soiling and deterioration of the microfilm when the prior art jacket was employed, during periods of extended storage and/or use. Moreover, even with the lip recessed in the manner illustrated, in order to provide a ready opening for insertion, there never-the-less still remained several problems with the prior art, namely that when the microfilm 50 is in fact inserted, under the conventional and normal modes of storage, the terminal end of the last portion of the film to be pressed inwardly remains exposed on its upper surface, as noted above, in the cut-away port by virtue of the recessed lip; another difficulty arises from the fact that even with the cut-away, the strip upper and lower sheets of the jacket are held close together thus requiring great care in the insertion by a person, and accordingly taking excessive time to insert each film individually with the personal care of the attendant, to be sure that it is threaded properly between the upper and lower sheets into the channel. Additionally, during the insertion of the leading end of the microfilm, great care has to be taken to assure that both of the leading corners become inserted beneath each of the separate angled portions of the lip; otherwise one corner may well be threaded beneath the upper half of the lip while accidently not being threaded below the upper remaining half, whereby at the converging point of the two half portions the microfilm end would be blocked against further insertion unless withdrawn and begun again, getting both corners beneath the upper sheet.

Accordingly, by reference to the FIG. 5 through FIG. 8 in particular, it may be seen how the microfilm 50 with its frames may be inserted beneath the upper convex lip edge and above a corresponding lower lip concave edge when the latter is flexed downwardly. The microfilm jacket upper sheet and a lower sheet jointly define a channel therebetween, between ultrasonic attaching seals connecting the upper and lower sheets. The forward concave lip of the microfilm jacket may be in a downwardly flexed state as would be affected by virtue of pressure of the lower face 31 of the feed device previously discussed and shown in phantom in this Figure, and upward pressure of the lower concave lip, thereby binding the leading edge of the microfilm jacket and providing for the flexing openly of the mouth thereof to expose the channel for insertion of the film 50 thereinto.

In further pointing out the novelty of the present invention, as compared to prior art, it is important to note that in the embodiments of the present invention as illustrated in FIGS. 5 through 8, there is no cut-out providing for insertion of a microfilm, rather there is solely a slit necessary—although it is never-the-less possible to employ with the present inventive feeding mechanism device, the prior art jackets also, the present jackets of the present invention are non-usable by industry in the absence of the novel feeding device of the present invention which provides for the flexing open of the inlet port. By virtue of the slits for example as shown in FIGS. 5 through 8, and, the slit is totally closed to exclude all dust and debris and exposure to the elements when the microfilm is not in the flexed state, thereby totally enclosing all portions of the microfilm including the trailing edge inserted. FIG. 5 illustrates a microfilm jacket, placed over the recently established international standard grid, illustrating the fact that the present inventive microfilm is in accord with the accepted international grid standard, and accordingly the novel feeding device of the present invention is adapted to such a standard and to such a microfilm jacket, and accordingly is preferably tailored to the use of such a jacket. Thus, for the jacket 67, the width of the channels 78 and 79 are equal to oneanother and to the width of the international grid channel standard, arrows as a', etc.-through 1 indicating a different scale.

FIG. 6 illustrates an alternate embodiment; instead of having a single mouth at the leading end of the strip, there may be a series of insert slits such as 80, 80', and 80'', etc., for a single channel of any desired predetermined length and numbers of serially consecutive mouths.

FIG. 7 is another preferred embodiment that might be desired for particular customers, in which at least one of the channels is substantially greater in width of the channel as compared to the width of remaining channels, thereby providing for insertion of a microfilm of greater width dimensions as well as microfilm of standard width dimensions in the channels of lesser widths. Accordingly, the channel 81 is substantially greater, approximately twice the normal width, as compared to the normal channel 82.

FIG. 8 illustrates typically microfilm jackets of the present invention of the type illustrated, for example, in FIGS. 5 through 7, except that this Figure illustrates the novel concept of providing such microfilm jacket in a continuous roll as in FIG. 1, and thus with serially consecutive mouths as in FIG. 6, for roll storage for example on a reel or roller rod before and/or subsequent to insertion of microfilms thereinto the channels thereof. Such a reel or roller roll of this continuous microfilm jacket could, for example, be utilized in the alternate embodiment feeder device illustrated in FIG. 1 by the leading edge of the microfilm jacket 67''' of the roll 83 with its rod-space 84, would be mounted with its microfilm jacket feed reel 85, fed through the grooved guide 86, which guide 86 is a stationary guide on the base 87. The base 87 is provided with alternate position selector 88 along which the carriage selector device 89 rides as a part of the laterally to and fro movable structure 90 carried on the rod 91 of the base 87. The structure 90 carries additionally the jacket take-up support structure 91 and reel 92 thereof, while the microfilm is fed from the microfilm feed reel 49*a*, into the feed and cutter mechanism 17*a* which is positioned and works substantially as that described and illustrated for FIGS. 2 and 3. Accordingly, the primary distinction between the embodiments of FIG. 2 and FIG. 1, are that in FIG. 2 it is the carriage with platform which is movable laterally to and fro, whereas in the FIG. 1 embodiment, the platform is stationary and it is the feed and cutter mechanism which is movably mounted on a carriage for lateral to and fro movement in order to select the particular channel of a microfilm jacket into which film is to be inserted. The FIG. 1 additonally also illustrating, however, the improved and preferred continuous jacket mechanism with the jacket take-up reel 92 within which the reeled microfilm jacket would be stored various strips of the microfilm cut from the initial microfilm 50 that was initially photographed onto film stored on the reel 49*a*.

Thus in each embodiment, the film 50 is caused to advance by mechanically turning a handle or knob to turn the shaft 26 together with its fixedly mounted wheel 55 such that surface 56 opposed by surface 53 of the upper biased wheel, causing the film 50 threaded between the opposing wheel surface to advance into mouth 59 and then out of mouth 61 of a common channel, onto the lower concave seat surface 62. The cutter edge or mouth 61 cuts by downward movement when the structure 27 is pivoted by the cutter handle 23, the edge of surface 62 being the opposing cutting surface, whereby the film strip is severed when the mouth edge 61 is pivoted to a state and position shown in FIG. 5A; prior to such cutting, the leading edge would have been threaded into the opened jacket mouth (slit) by virtue of mounting the leasing portion just forward of the mouth such that that leading portion is bent downwardly as shown in FIG. 9. Thereafter, a handle is further turned, pushing the film well-beneath the lip 73.

It is within the scope of the present invention to make such modifications and variations and substitutions as would be apparent to a person of ordinary skill.

I claim:

1. A microfilm jacket having upper and lower elongated sheets extending between proximal and distal ends thereof with fused opposing faces positioned one above the other and the fused opposing faces being in contact and fused to one-another at spaced-apart lines, said lines defining a storage through-space conduit along a longitudinal axis of the upper and lower elongated sheets, and the storage through-space conduit having an outlet opening between said upper and lower elongated sheets at said distal end, said upper elongated sheet having a plurality of insert openings in series, and said plurality and said outlet opening being in common communication with through-space of said storage throughspace conduit; and said upper elongated sheet including slit-structures each forming one of said insert openings as a normally-closed arced slit extending up to one of said spaced-apart lines at each of opposite ends of the normally-closed arced slit, each normally-closed arc slit extending transversely to said longitudinal axis; and for each of said plurality, said slit structure consisting of a first section of the upper elongated sheet having a lower concave lip and in opposing relationship thereto on upper convex lip of a second section of the upper elongated sheet, at least one of the normally-closed arced slits being positioned in a direction toward said proximate end, the upper convex lip extending toward the proximal end; each said upper convex lip along with its respective lower concave lip, and storage space of the storage through-space conduit, and said outlet opening jointly forming said storage through-space conduit for each insert opening of said series; said series extending between said proximal and distal ends; each said slit-structure being adapted to form an insertion open space receivable of a microfilm strip lengthwise when the lower concave lip is pressed downwardly sufficiently for said first section of an upper surface of said upper elongated sheet in a direction toward said proximal end to form an angle with said second section of an upper surface of said upper elongated sheet in a direction from the upper convex lip toward said distal end; whereby microfilm strip is optionally insertable through alternate ones of said insert openings.

2. A microfilm jacket of claim 1, in which said storage through space conduit is open at each of opposite ends.

3. A microfilm jacket of claim 2, in which said upper and lower sheets are attached at other spaced-apart points forming additional substantially parallel substantially enclosed elongated continuous channel spaces.

* * * * *